US007475581B2

(12) United States Patent
Farnik

(10) Patent No.: US 7,475,581 B2
(45) Date of Patent: Jan. 13, 2009

(54) METHOD OF INCREASING THE CONTROL PRECISION OF THE PATH OF A PRODUCT IN A LEVELLING MACHINE WITH INTERLOCKING ROLLERS, AND LEVELLING INSTALLATION USED TO IMPLEMENT SAME

(75) Inventor: Andrzej Farnik, Cormeilles En Parisis (FR)

(73) Assignee: Siemens VAI Metals Technologies SAS, Saint Chamond (FR)

( * ) Notice: Subject to any disclaimer, the term of this patent is extended or adjusted under 35 U.S.C. 154(b) by 0 days.

(21) Appl. No.: 10/574,701

(22) PCT Filed: Sep. 28, 2004

(86) PCT No.: PCT/FR2004/002457

§ 371 (c)(1),
(2), (4) Date: Apr. 5, 2006

(87) PCT Pub. No.: WO2005/046899

PCT Pub. Date: May 26, 2005

(65) Prior Publication Data

US 2007/0055393 A1 Mar. 8, 2007

(30) Foreign Application Priority Data

Oct. 13, 2003 (FR) ..... 03 12012

(51) Int. Cl.

| | |
|---|---|
| ***B21D 1/02*** | (2006.01) |
| ***B21D 3/02*** | (2006.01) |
| ***B21B 37/16*** | (2006.01) |
| ***B21B 38/00*** | (2006.01) |
| ***B21K 29/00*** | (2006.01) |
| ***B21H 1/22*** | (2006.01) |
| ***G01L 1/00*** | (2006.01) |
| ***G01L 25/00*** | (2006.01) |
| ***G06F 19/00*** | (2006.01) |
| ***G01C 9/00*** | (2006.01) |
| ***G01B 5/02*** | (2006.01) |
| ***G01B 7/02*** | (2006.01) |
| *B21B 37/58* | (2006.01) |
| *B21B 1/08* | (2006.01) |
| *B21D 13/00* | (2006.01) |
| *G01B 7/16* | (2006.01) |
| *G05B 13/02* | (2006.01) |
| *G05B 19/18* | (2006.01) |

(52) U.S. Cl. ..... 72/160; 72/7.2; 72/8.1; 72/10.4; 72/10.7; 72/28.2; 72/31.07; 72/128; 72/199; 72/379.6; 73/767; 702/85; 702/94; 702/97; 702/105; 702/150; 702/154; 702/155; 702/158; 700/29; 700/56; 700/122; 700/156; 700/160; 700/167

(58) Field of Classification Search ..... 72/6.1, 72/6.2, 7.2, 8.1, 10.1, 10.4, 10.7, 28.1, 28.2, 72/31.01, 31.07, 127, 160, 199, 362, 379.2, 72/379.6; 700/28, 29, 56, 117, 122, 145, 700/148, 150, 155, 156, 159, 160, 167, 169, 700/170; 73/767; 702/85, 94, 97, 105, 150, 702/154, 155, 158

See application file for complete search history.

(56) References Cited

U.S. PATENT DOCUMENTS

| | | | | |
|---|---|---|---|---|
| 4,454,738 | A | 6/1984 | Buta | |
| 4,730,472 | A | 3/1988 | Ellis | |
| 5,666,836 | A * | 9/1997 | Bonnefont et al. | 72/7.2 |
| 5,680,785 | A * | 10/1997 | Quehen et al. | 72/10.1 |
| 5,758,533 | A * | 6/1998 | Quehen et al. | 72/163 |
| 6,993,947 | B2 * | 2/2006 | Tondo et al. | 72/31.07 |

FOREIGN PATENT DOCUMENTS

| | | |
|---|---|---|
| EP | 0 570 770 | 11/1993 |
| FR | 2 732 913 | 10/1996 |
| FR | 2 816 856 | 5/2002 |

* cited by examiner

*Primary Examiner*—Crystal J Barnes Bullock
(74) *Attorney, Agent, or Firm*—Oblon, Spivak, McClelland, Maier & Neustadt, P.C.

(57) ABSTRACT

A method of increasing control precision of a path of a product in a leveling machine including: a fixed support cage; two leveling assemblies with parallel rollers, which are placed above and below the strip respectively; devices necessary to adjust the interlocking of the rollers; a mechanism for measuring leveling forces at least of two sides of the machine; and a theoretical pre-setting model. The method directly measures at least one value for the spacing of the leveling rollers, which is compared to reference values, and uses the members for adjusting the position of the leveling rollers to maintain the measured values equal to the reference values. The method is particularly suitable for machines used to level flat metal products.

15 Claims, 2 Drawing Sheets

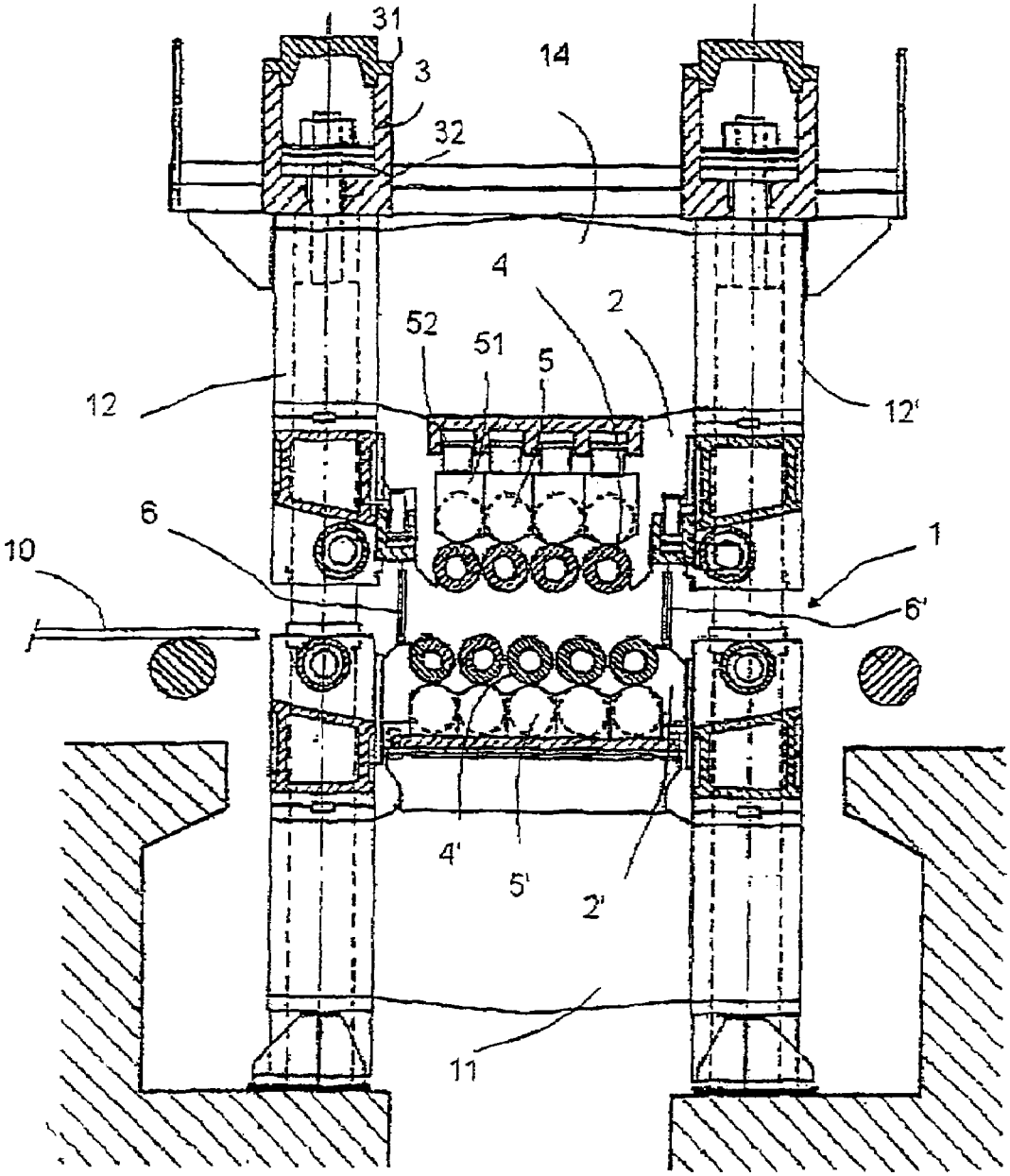
- Fig.1 -

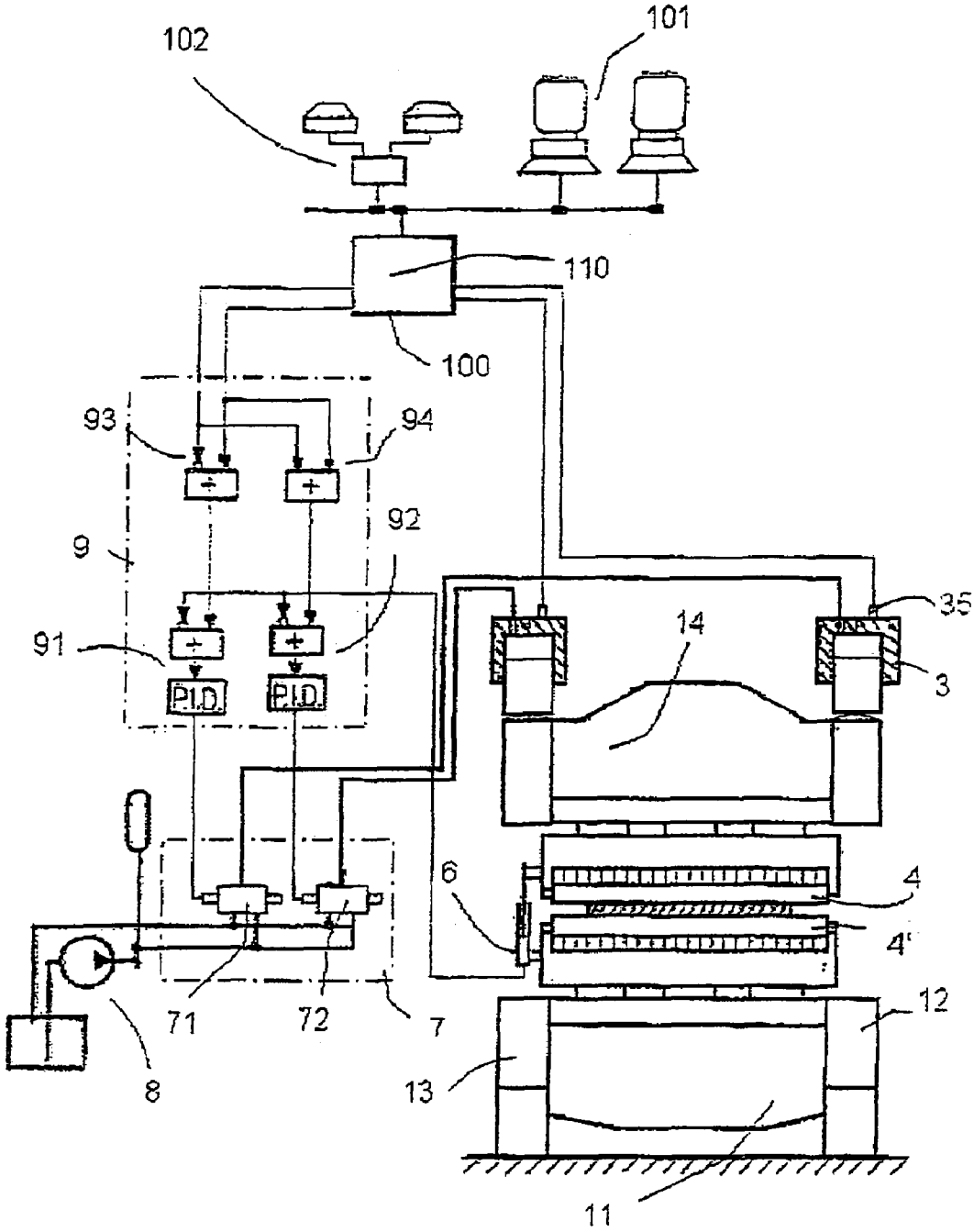
- Fig.2 -

METHOD OF INCREASING THE CONTROL PRECISION OF THE PATH OF A PRODUCT IN A LEVELLING MACHINE WITH INTERLOCKING ROLLERS, AND LEVELLING INSTALLATION USED TO IMPLEMENT SAME

The subject of the invention is a method of increasing the precision in controlling the path of a product through a roller leveler consisting of imbricated rolls and the leveling installation for implementing the method.

To level flat products, particularly rolled metal strip, it is often the practice to use a multi-roll leveler comprising two leveling assemblies each supporting a series of rolls with parallel axes that are placed respectively above and below the strip, the rolls being longitudinally and vertically offset so as to be imbricated, thereby defining an undulating path for the strip which is thus subjected to tensile and bending forces in alternate directions.

The operation of such a leveler has been the subject of advanced theoretical approaches. These leveling theories are based on the calculation of the maximum curvatures of the plate in the leveler—these curvatures result in plastic deformation of the material in the thickness of the product that determines the relieving of the stresses in the width and thickness directions. Any leveler may be divided into two zones, the functions of which are very different but complementary and interactive. The entry zone, which comprises the first three or four rolls, is a zone for substantial plastic deformation, in which the visual flatness defects, such as wavy edge, center fullness and "quarter buckle" defects, and also any nonuniform transverse distribution of the longitudinal stresses, are eliminated. The exit zone, which comprises three or four rolls, has the function of reducing the normal and transverse stress gradients in the thickness in order to ensure that the plate has virtually zero residual camber and curl.

It is known to carry out sophisticated theoretical calculations for obtaining a precise theoretical result able to be used for presetting the levelers. The principle is based on progressively decreasing the degree of plastic deformation. This can be obtained only with levelers having a sufficient number of leveling rolls and allowing the imbrication of each of these rolls to be suitably set. Although the precision required for the first rolls is relatively low, since the desire is to achieve a high degree of plastic deformation, that needed for setting the rolls in the exit zone is high, this being the more so the thinner the plate to be leveled. It is therefore desirable to have levelers in which all the rolls are independently set, with sufficient, reliable and reproducible precision.

A leveling installation therefore comprises, in general, a fixed support stand, two leveling assemblies consisting of parallel rolls, these assemblies being placed above and below the strip respectively, and the rolls of which are imbricated so as to define an undulating path for the strip and means for setting and maintaining the separation of said leveling assemblies by bearing on the fixed stand in order to set the imbrication of the rolls, each leveling assembly comprising a row of parallel work rolls that bear on a support frame via at least one row of rotatably mounted back-up rolls, at their ends, each on two bearings that define a rotation axis perpendicular to the run direction, said bearings being supported, respectively, by two lateral parts integral with the support frame.

Very often the lower leveling assembly is fixed in terms of position, it being possible for the upper leveling assembly to move vertically in order to set the imbrication. For this purpose, it is general practice to use four mechanical or hydraulic actuators mounted in the corners of the frame and allowing the general level of the adjustable leveling assembly to be set relative to the fixed lower leveling assembly, and consequently the imbrication of the rolls. Furthermore, the entry and exit actuators may be set differently, which makes it possible to determine in general a tilt needed to achieve the two leveling effects established by the theory and presented above. The actuators may also be set differently on one side relative to the other by introducing a lateral tilt, so as to correctly distribute the leveling effect over the width of the product to be leveled.

The forces generated during the leveling operation are very high, in particular when this operation is carried out on thick plate after hot rolling and rapid cooling, or else on cold plate. It is therefore necessary to give levelers as rigid a structure as possible so as to be able to control the leveling forces. The deformation under the load of the various parts of the leveler (this deformation is also called stretch) falsifies the precision in controlling the position of the leveling rolls, and therefore falsifies the precise value of the curvature obtained on each roll. The overall stretch of the leveler modifies the intended degree of plastic deformation, and therefore runs the risk in the entry zone of not completely eliminating the flatness defects. It also modifies the degree of reduction in plastic deformation, and therefore the transition with the exit zone, and runs the risk of not eliminating the residual stresses as predicted. In addition, a transverse stretch, from one side to the other, may be produced which will modify the degree of plastic deformation in the entry zone and its uniformity over the width of the product. It may even create flatness defects.

To alleviate these drawbacks, hydraulically controlled levelers have been produced for displacing the movable leveling assembly and also for individually controlling each leveling roll, and associated therewith is a stretch model based on the force measurements and a theoretical calculation of the deformations of the leveler under load in order to compensate for these deformations, as in the Applicant's patent FR 2 732 913.

However, all these compensations are vitiated by errors that are due to the nonlinearities of the leveler's stretch and are the result of frictional forces that are found between the fixed parts and the moving parts of the leveler. In addition, the stretch modulus of a leveler, even of robust design, is of the order of 100 t/mm per column. Now, the leveling force for a plate 3 meters in width may be from 1000 tonnes to 2500 tonnes, resulting in a stretch (without compensation) of 2.5 mm to 5 mm. The required precision is not very high in the entry zone of the leveler and could make do with a simple stretch compensation. However, there would be the risk of the product refusing to engage in a leveler set too tightly as a precaution. In contrast, the precision needed on the curvatures for eliminating the residual stresses in the exit zone requires a precision in controlling the position of the rolls of a few tenths of a millimeter. Finally, to control the transition zone requires having precise control over practically all of the rolls, all the more so as, for certain applications, the pitch of the rolls held rigidly in position are varied so as to increase the capacity of the leveler, as indicated in patent FR 2 732 913. This will have the effect of shifting the entry zone and the exit zone and will therefore also contribute to seeking greater precision in controlling the position of all of the rolls of the leveler.

The object of the invention is to increase the control precision in these levelers and a leveler equipped with a novel control device that allows all of these problems to be solved without complicating the devices used or entailing an excessive cost.

The stretch compensation is replaced with a real-time model for presetting the position of the leveling rolls combined with direct measurement of the separation of the work rolls.

In one method according to the invention, a theoretical presetting model is installed which gives at least one reference value for presetting the imbrications and at least one value of the separation of the leveling rolls is measured directly, this being compared with the reference values, and the members for setting the position of the leveling rolls are acted upon in order to keep the measured values equal to the reference values so as to keep the path of the product to be leveled in the leveler in accordance with the undulation predicted by the model for implementing the leveling operation. In particular, two measurements of the value of the separation of the leveling rolls are taken, a first at the entry of the leveler and a second at the exit of the leveler respectively, in that each of these measurements is compared with the reference value given by the model for the same rolls, at the entry and exit of the leveler respectively, and the members for setting the position of the leveling rolls, at the entry and exit of the leveler respectively, are acted upon in order to keep the measured value equal to the reference value so as to be able to achieve the decrease in degree of plastic deformation predicted by the model for implementing the leveling operation. In the complete method according to the invention a measurement of the value of the separation of each of the leveling rolls is taken and is compared with each reference value given by the model and the individual members for setting the position of each of the leveling rolls is acted upon in order to keep the measured value equal to the reference value so as to achieve the undulation and the decrease in degree of plastic deformation that are predicted by the model for implementing the leveling operation. However, the position control requires the assurance that, identical leveling forces correspond to uniform positions of the leveling rolls, these positions being given by the position sensors. It is necessary beforehand to carry out a kind of calibration so as not to be dependent on the way in which the sensors are mounted in the leveler and on the position of their "zero" reference.

In one method according to the invention, equileveling of the work rolls is carried out using a flat machined plate of known thickness by modifying the position of the work rolls in a differential manner by a lateral tilt from one side onto the other so as to equalize the leveling forces on the two sides of the leveler that are measured by the measurement devices. In a more sophisticated method of the invention, the equileveling is carried out using a running plate by modifying the position of the work rolls in a differential manner by a lateral tilt from one side onto the other and in that the average values of the forces recorded by the measurement devices, on each side during said run are equalized.

In a parallel-roll leveling installation according to the invention, a device is used that enables the separation of the leveling rolls at at least one point to be measured directly so as to know the precise value of the imbrication by direct measurement. The installation also includes, and again according to the invention, one electronic device for slaving the measured separation of the leveling rolls to the theoretical value given by the model by acting on the imbrication-setting devices. In an improved version of the invention, the imbrication-setting devices are hydraulically controlled.

In another arrangement of a leveling installation according to the invention, the installation is provided with a device enabling the separation of the leveling rolls at at least two points to be measured directly, one located in the entry zone and the other located in the exit zone of the leveler. In this case, the electronic device makes it possible to slave the measured separation of the leveling rolls located in the entry zone and in the exit zone of the leveler respectively to the theoretical value given by the model for the separation of the rolls located in the entry zone and the exit zone of the leveler respectively by acting independently on the devices for setting the imbrication of the rolls in each of the entry and exit zones respectively. Preferably, these devices are hydraulically controlled.

In a greatly improved arrangement of the invention, independent devices allow the separation of each pair of leveling work rolls to be measured directly and individually. The parallel-roll leveling installation includes a means for individually setting the position of each leveling roll and an electronic device for slaving the measured separation of each of the leveling rolls to the theoretical value given by the model for the separation of each of these rolls by acting independently on their imbrication-setting device.

Advantageously, the leveling installation includes a hydraulically controlled device for setting the imbrication of each roll.

In a parallel-roll leveling installation according to the invention, the electronic devices for slaving the measured separation of the leveling rolls to the theoretical value given by the model include a differential setting device for setting a lateral tilt of the rolls on one side relative to the other and with respect to the setpoint value, in order to tare the device by an equileveling method using a flat machined plate of known thickness.

However, the invention will be more clearly understood from the description of certain particular embodiments given by way of example and shown in the drawings.

FIG. 1 is a side view of the installation, in cross section in its vertical mid-plane parallel to the run direction, the leveling assemblies being in the open position.

FIG. 2 is a diagram of all of the control circuits for the cylinder actuators.

FIG. 1 shows the mechanical part of an entire installation according to the invention, which comprises, in general, a support stand 1, an upper multi-roll leveling assembly 2 and a lower multi-roll leveling assembly 2'.

In general, the fixed support stand 1 comprises a lower support beam 11, two lateral uprights placed on either side of the longitudinal mid-plane P in which the strip 10 to be leveled runs, and an upper support beam 14.

Each lateral upright consists of a pair of spaced-apart columns 12, 12', 13 (in the figures, only three columns are visible). These columns and the upper support beam, generally forming a rigid panel, are equipped with various devices known per se and widely described in the prior art, which can cooperate so as to allow the upper support beam 14 to slide vertically along the four columns 12, 12', 13. This movement may be mechanical, using motorized or hydraulic screws as shown in FIG. 1. In this case, there are four cylinder actuators 3 fitted at the top of each column. In the arrangement shown, each cylinder actuator consists of a body 31 fixed to the support beam 14 and a piston 32 integral with the column. Since the lower support beam 11 is fixed, the upper support beam 14 can therefore move with the action of the four cylinder actuators 3, the pistons of the cylinder actuators remaining at the same level. The cylinder actuators 3 are positioned so as to set the desired imbrication of the rolls with respect to the thickness of the plate to be leveled so as to achieve the undulation defined by the theoretical model. They exert leveling force during passage of the product.

Other arrangements may also be imagined, such as that comprising movable pistons and fixed cylinder actuator bodies, without departing from the scope of the invention.

Each leveling assembly 2, 2' comprises a row of work rolls 4, 4' associated with a row of back-up rolls 5, 5', all these being supported by a frame.

Each work roll 4, 4' is mounted so as to rotate on two bearings that define its axis of rotation and it bears on a back-up roll 5, 5' mounted so as to rotate on two end bearings.

In the representation shown in FIG. 1, the end bearings 51 of the upper leveling assembly 2 bear on the upper support beam via a support member 52. In a more sophisticated version of the invention, this support member may include a setting device that allows the imbrication of each work roll to be individually modified, the overall value of the imbrication being given by positioning the support beam for the upper leveling assembly 2 by means of the cylinder actuators 3. These setting devices may be mechanical, such as for example a wedge system, or else they may consist of a row of hydraulic cylinder actuators as in patent FR 2 732 913. In this case it will be possible in addition to individual imbrication setting, to obtain, by differential setting of the cylinder actuators of any one row, a camber effect of the work rolls so as to better distribute the leveling effect over the width of the strip to be leveled.

According to one essential feature of the invention, at least one sensor 6 is used for permanently measuring the absolute value of the spacing of the work rolls 4, 4', independently of the deformation of the columns and of the entire leveler, said sensor being fitted for example between the upper 2 and lower 2' leveling assemblies. In the representation shown in FIG. 1, two sensors 6 and 6' are shown, one at the entry of the leveler and the other in the exit zone so as to be able to control the variation in the degree of plastic deformation more precisely, as was described in the general presentation of the problem.

In one particular embodiment of the invention, and for a wider use of all options of the leveler, a sensor may be fitted for individually measuring the separation of each pair 4, 4' of work rolls.

The sensors may be of any type, for example of the LVDT (Linear Variable Differential Transformer) type with the body fixed to one leveling assembly and the stem to the other. They may also be contactless, for example ultrasonic sensors, laser sensors, optical-filter sensors, Bragg grating sensors, etc.

FIG. 2 shows all of the associated mechanical and electrical devices for constituting a leveler according to the invention. The mechanical part of the leveler is shown schematically in cross section. The sensor or sensors 6 are mounted on one side of the leveler and the hydraulic cylinder actuators 3 are fitted with sensors 35 for measuring the overall leveling forces. These cylinder actuators are supplied by a conventional pump/accumulator device 8 via two servovalves or two groups of servovalves 71, 72 each supplying one side of the leveler. These servovalves are controlled by at least one electronic control circuit made up of two electronic circuits each controlling one servovalve or group of servovalves.

In an installation according to the invention, the measured value of the spacing of the work rolls 4, 4' is subjected to closed-loop feedback control with respect to the reference position introduced into the electronic servovalve control circuit.

These electronic circuits (91, 92), which may be analog or digital computers, include summing circuits and conventional PID (proportional integral differential) control circuits.

In a preferred arrangement of the invention, the reference values corresponding to the desired imbrication of the work rolls are generated by a leveling model 110 implemented in a process computer 100. These values are introduced into the electronic servovalve control circuits (91, 92) via a summer/differentiator stage 93, 94 which makes it possible to introduce a command for tilting the leveler on one side relative to the other. The force sensors 35 are connected to the computer 100, in which a tilt setpoint will be generated, this being added to the imbrication reference in the circuit 94 before being sent as a control signal for one side of the leveler. It is differentiated with respect to the same signal in the circuit 93 before being sent as a control signal for the other side of the leveler.

Moreover, the computer 100 is conventionally connected to operator interfaces, such as screen and control desk 101 and printer/recorder 102 so as to be able to control the operation of the leveler and to manage its production.

In a more sophisticated embodiment of the invention, for example with one sensor in the entry zone and the other in the exit zone of the leveler, the same type of circuit will be used. The cylinder actuators 3 located on the entry side and those on the exit side are supplied separately via servovalves and all the electronic circuits 9 described above are duplicated in order to control each zone independently. Of course, this is the same computer 100 that generates all the reference values and delivers them to all of the electronic control circuits.

In another embodiment, again according to the invention, the support members 52 for each upper back-up roll 5 are members for setting and individually controlling each upper work roll 4, a measurement of the separation between each of the upper and lower work rolls is made individually and separately, and a control device similar to that described is fitted for each pair of work rolls.

If the support members 52 are setting members consisting of hydraulic cylinder actuators, a control device (9) of the type described above is produced for each pair of work rolls.

The computer 100 is used to generate all the setpoints and to deliver them to all the electronic control circuits 9. In this case, the main cylinder actuators 3 no longer serve for these functions, but are used to generally open and close the leveler according to the thickness of the plate to be leveled. The precise undulation desired is obtained by setting the individual imbrication of each roll 4 by means of the setting devices 52.

In one method according to the invention, the separation of the work rolls 4, 4' is measured and compared with the reference setpoint generated by the leveling model, and the correction needed to cancel out the error resulting from the deformations of the leveler under the leveling force is introduced by acting on the imbrication-setting means. The absolute value of the separation of the work rolls is measured by the sensors 6, this value is compared with the reference value in circuits 91 and 92, and the resulting signal is used to control the servovalve 7, which makes it possible to displace the cylinder actuators 3 controlling the movement of the leveling equipment.

The reference value is obtained by combining the dimension generated by the leveling model 110 with the tilt setpoint. The two quantities are added in the circuit 94 before being applied to one side of the leveler and they are subtracted in the circuit 93 before being applied to the other side of the leveler, so as to produce a balanced and distributed tilt per side relative to the theoretical imbrication value needed to obtain the undulation defined by the model.

In a preferred embodiment of the invention, an absolute measurement of the separation of the work rolls 4, 4' is taken in the entry zone of the leveler, and another one in the exit zone. These measurements are compared with the reference setpoints generated by the leveling model for each of these two zones and the corrections needed to cancel out the errors resulting from the deformations of the leveler under the leveling force are introduced by acting on the imbrication-setting means 3 in the entry zone and in the exit zone by separately acting by means of specific control circuits of the cylinder actuators 3 for the entry zone and those for the exit zone.

In another embodiment of the invention, an absolute measurement of the separation of the work rolls 4, 4' for each pair of work rolls is taken. These measurements are compared with the reference setpoints generated by the leveling model 110 for each of the pairs of work rolls and the corrections needed to cancel out the errors resulting from the deformations of the leveler under the leveling force are introduced by acting on the imbrication-setting means 52 for each pair of work rolls.

It should be pointed out that the lower leveling assembly has one more roll than the upper leveling assembly. Consequently, an upper leveling roll is always in the space between two adjacent lower leveling rolls. Under these conditions, the distance between the horizontal tangent to an upper work roll and the tangent to the two lower rolls lying beneath the upper roll is called the "nip". This nip may be measured by taking the average of the distances of the upper roll from each of the two corresponding lower rolls.

In all cases, and according to the method of the invention, the imbrication reference values generated by the leveling model 110 are added to a tilt setpoint in order to control one side of the leveler and subtracted in order to control the other side, so as to produce a balanced and distributed tilt per side with respect to the theoretical imbrication value needed to obtain the undulation defined by the model. Of course, and again within the context of a method according to the invention, if the means 52 for individually setting the imbrication of the work rolls consist of a row of hydraulic cylinder actuators, it will be advantageous to superimpose on the setting of the imbrication of the row of cylinder actuators, an individual differential setting of each cylinder actuator, making it possible to produce a camber effect on the work roll so as to obtain better distribution of the leveling force over the width of the product to be leveled.

In one method according to the invention, the tilt setpoints are generated during an equileveling phase using a flat machined product of known thickness serving as gauge.

This product or gauge is introduced into the leveler and a slight imbrication is initiated so as to cause the work rolls to clamp onto the product or gauge. The leveling forces induced on each side of the leveler are then measured, for example using the force sensors 35 fitted to the cylinder actuators 3 when a leveler of the type described in FIG. 2 is provided therewith. A tilt is then commanded so as to balance the forces on both sides of the leveler, if they were not balanced initially, by tightening up that side of the leveler generating the smaller force, and the value of the tilt for equalizing the forces on each side is noted. This entire sequence is managed by the computer 100, which stores the values of the forces and those of the tilts produced. These values are then used during operation of the leveler as tilt presetting for all the imbrication settings that will be determined by the model installed in the computer 100 and according to the embodiment described above. This equileveling procedure is, according to the invention, used with all the methods of implementation described, that is to say may be carried out by two groups of cylinder actuators 3 (one group for each side of the leveler) if there is only one sensor for measuring the separation of the work rolls, but it may also be used by carrying out a simultaneous but independent equileveling of the cylinder actuators 3 for the entry zone and those for the exit zone if a measurement is made in each of these zones.

It is also possible to establish an equivalent equileveling procedure, and again according to the method of the invention, in the embodiment for which support device 52 for each upper work roll 4 is a device consisting of a row of hydraulic cylinder actuators, and also of an absolute measurement of the separation for each pair of work rolls. The procedure is the same and consists in tilting each pair of work rolls until the forces applied on their ends are equalized and in using this tilt value as setpoint for the entire subsequent operation of the leveler.

According to an improved method of the invention, the equileveling is carried out on a running strip. To do this, a flat machined product of known constant thickness is used, a slight imbrication of the work rolls is initiated, corresponding to a dimension slightly smaller than the thickness of the product serving as gauge, and the product is introduced and made to run through the leveler. The forces generated on each side of the leveler are measured and stored, and their average values over the entire run time are calculated. The equileveling procedure will then be carried out by introducing the tilt that will equalize these average values.

Of course, the invention is not limited to the detailed embodiments that have been described simply by way of example, it being possible for alternative embodiments to be used without departing from the scope of the claims.

In one simplified embodiment in which a single sensor 6 for measuring the separation of the work rolls 4,4' is fitted, for example in the central zone of the leveler, it is conceivable to introduce an adjustable tilt between the entry zone and the exit zone by introducing it into the electronic circuit 9 so as to decrease the degree of plastic deformation, which may be necessary in certain cases.

To summarize, to level a plate by the method according to the invention, the procedure starts by calculating, using a leveling model, the spacings that the leveling rolls must have under load. The leveling model that can be used is for example a model known to those skilled in the art. Such a model calculates the behavior of the product to be leveled and of the leveler on the basis of the geometrical and mechanical characteristics of the plate to be leveled and of the leveler (for example: thickness and width of the plate; yield strength at the leveling temperature of the metal of which the plate is made; possibly the amplitude and nature of the defects; number of leveling rolls; distance between rolls of any one leveling assembly; diameter of the rolls).

A model makes it possible, using methods that can be implemented by those skilled in the art, to determine the optimum setting of the leveler and also to determine the clamping setpoints, especially at the leveler entry and exit.

The setting setpoints may be supplemented with setpoints for balancing between the two sides of the leveler, these setpoints being determined by the equileveling operation.

Firstly, a blank (no-load) presetting of the leveler is carried out using the setting setpoints optionally supplemented with the balancing setpoints, and then, during the leveling operation (when the leveler is under load), the spacings of the work rolls as measured are regulated so that they remain approximately equal to the setpoint values.

The reference symbols inserted after the technical features mentioned in the claims have the sole purpose of making it easier to understand the claims but in no way limit their scope.

The invention claimed is:

1. A method of increasing precision in controlling a path of a product through a roller leveler including two leveling assemblies including parallel rolls, the assemblies being placed above and below the product respectively, members configured to set imbrications of the rolls, the method comprising:

presetting the imbrications by using a presetting model including a reference value for presetting the imbrications;

measuring, during a leveling operation, an absolute separation value between an upper and a lower leveling assembly of the two leveling assemblies, and comparing the value with the reference value; and setting the position of the leveling rolls to keep the measured value equal to the reference value so as to keep the path of the product to be leveled in the leveler in accordance with an undulation of the leveled product predicted by the presetting model.

2. The method of increasing the control of the path of the product in a leveler as claimed in claim 1, further comprising:

taking first and second measurements of the absolute separation value between the upper and the lower leveling assembly, the first measurement taken at an entry side of the leveler and the second measurement at an exit side of the leveler, respectively, comparing each of the measurements with the reference value given by the model; and setting the position of the leveling rolls, at the entry and exit of the leveler, respectively, to keep the measured value equal to the reference value to achieve a decrease in degree of a plastic deformation of the leveled product predicted by the presetting model.

3. The method of controlling the path of the product through a leveler as claimed in claim 1, further comprising:

measuring the absolute separation value of each of the leveling rolls between the upper and the lower leveling assembly;

comparing each of the measurements with the reference value given by the presetting model; and setting the position of each of the leveling rolls to keep the measured value equal to the reference value so as to achieve and undulation of the leveled product and decrease in degree of plastic deformation of the leveled product that are predicted by the presetting model.

4. The method of controlling the path of the product through a leveler as claimed in claim 1, further comprising:

measuring leveling forces on at least on each side of the leveler;

equileveling the work rolls using a flat machined plate of known thickness by modifying the position of the work rolls in a differential manner by a lateral tilt from one side onto the other side so as to equalize the leveling forces on the two sides of the leveler.

5. The method of controlling the path of the product through a leveler as claimed in claim 4, wherein said equileveling further comprises:

using a running plate by modifying the position of the work rolls in a differential manner by a lateral tilt from one side onto the other; and equalizing average values of the forces recorded by said measuring leveling forces on each side during a run with the running plate.

6. A parallel-roll leveling installation for implementing the method as claimed in claim 1, comprising:

a fixed support stand;

two leveler assemblies of parallel rolls placed above and below the product respectively;

devices configured to set the imbrication of the rolls;

a device configured to measure leveling forces at least on each side of the leveler; and at least one device configured to separate the leveling rolls at at least one point and to measure the separation of the rolls.

7. The parallel-roll leveling installation as claimed in claim 6, further comprising:

at least one electronic device configured to control the devices for setting the imbrication so that the measured separation of the leveling rolls will by controlled to a theoretical value given by a model.

8. The parallel-roll leveling installation as claimed in claim 7, wherein the devices for setting the imbrication are hydraulically controlled.

9. The parallel-roll leveling installation as claimed in claim 8, wherein the at least one electronic device configured to control the measured separation of the leveling rolls to the theoretical value given by the model that the installation is further configured to set a differential lateral tilt of the rolls on one side relative to the other side with respect to a setpoint value.

10. The parallel-roll leveling installation as claimed in claim 6, further comprising:

a device configured to separate the leveling rolls at at least first and second points, and configured to measure the separation of the rolls, the first point located in an entry zone and the second point located in an exit zone of the leveler.

11. The parallel-roll leveling installation as claimed in claim 10, further comprising:

at least one electronic device configured to control a measured separation of the leveling rolls located in the entry zone and in the exit zone of the leveler respectively to the theoretical value given by a model for the separation of the rolls located in the entry zone and the exit zone of the leveler respectively, by acting independently on the devices configured to set the imbrication of the rolls in each of the entry and exit zones respectively.

12. The parallel-roll leveling installation as claimed in claim 11, wherein the devices configured to set the imbrication are hydraulically controlled.

13. The parallel-roll leveling installation as claimed in claim 6, further comprising:

a device configured to separate of each pair of leveling work rolls and to measure the separation directly and separately.

14. The parallel-roll leveling installation as claimed in claim 13, further comprising:

at least one device configured to individually set a position of each leveling roll; and at least one electronic device configured to control a measured separation of each of the leveling rolls to the theoretical value given by a model for the separation of each of the rolls by acting independently on the respective device configured to set the imbrication.

15. The parallel-roll leveling installation as claimed in claim 14, wherein the device configured to set the imbrication of each roll is hydraulically controlled.

* * * * *